United States Patent [19]

Givol

[11] Patent Number: 4,539,829

[45] Date of Patent: Sep. 10, 1985

[54] CYLINDER LOCK PERMITTING EXTRACTION OF BROKEN KEY

[75] Inventor: Benny Givol, Jerusalem, Israel

[73] Assignees: Micha Altmann; Yoel Ben-Yehuda, both of Israel; part interest to each

[21] Appl. No.: 477,788

[22] Filed: Mar. 22, 1983

Related U.S. Application Data

[63] Continuation-in-part of Ser. No. 261,323, May 7, 1981, abandoned.

[51] Int. Cl.[3] ..... E05B 15/08

[52] U.S. Cl. ..... 70/454; 70/375; 70/385

[58] Field of Search ..... 70/379 R, 380, 453, 70/454, 375, 385

[56] References Cited

U.S. PATENT DOCUMENTS

| | | | |
|---|---|---|---|
| 437,939 | 10/1890 | Sargent | 70/453 |
| 3,736,780 | 6/1973 | Singer | 70/382 |

*Primary Examiner*—Robert L. Wolfe

*Attorney, Agent, or Firm*—Beveridge, De Grandi & Weilacher

[57] ABSTRACT

A cylinder lock which comprises a housing and, rotatably accommodated therein, a cylinder having an axially extending key slot for reception of, and rotation by, a mating key to unlock the lock. The cylinder is provided on at least one of its ends with an end plate having a similar key slot cut therethrough and means for removably attaching the end plate to the cylinder with the key slot of the end plate in register with the key slot of the cylinder to permit insertion, through the end plate, into the cylinder, of the key, whereby in case of a broken key, the end plate can be removed from the cylinder, thereby exposing a portion of the broken key, facilitating extraction thereof.

5 Claims, 7 Drawing Figures

CYLINDER LOCK PERMITTING EXTRACTION OF BROKEN KEY

This application is a continuation-in-part of application Ser. No. 261,323 filed May 7, 1981 and now abandoned.

The present invention relates to locks, particularly to so-called cylinder locks having pin tumblers and flat, grooved-profile keys.

Because, although not really unpickable, such cylinder locks provide a reasonable degree of safety; because of their compactness and the ease with which spare keys are produced, these cylinder locks are today widely used for all sorts of locking applications.

Yet regardless of specific make, these locks suffer from a serious drawback: The flat, grooved-profile keys of these locks having a relatively weak cross section and being exposed to relatively large shear stresses, they not infrequently break, invariably at the plane of maximum stress, which is the outer face of the cylinder. The broken shaft of the key thus remains inside the cylinder and, being now substantially flush with the cylinder face, is very difficult, if not impossible, to extract without use of special tools. In such cases it is thus often necessary to either break in whatever the lock was designed to guard for instance, the door, or to try and find a person qualified to do the job by application of skill rather than violence. Both alternatives are costly, in terms of expenses incurred and time lost.

It is one of the objectives of the present invention to overcome the drawbacks of the prior-art locks and to provide a cylinder lock of such design as to facilitate extraction of a broken key by anybody able to handle a screwdriver and a pair of household pliers.

This the invention achieves by providing a cylinder lock comprising a housing and, rotatably accommodated therein, a cylinder having an axially extending key slot for reception of, and rotation by, a mating key to unlock said lock, said cylinder being provided on at least one of its ends with an end plate having a similar key slot cut therethrough and means for removably attaching said end plate to said cylinder with the key slot of said end plate in register with the key slot of said cylinder to permit insertion through said end plate, into said cylinder, of said key, whereby in case of a broken key, said end plate can be removed from said cylinder, thereby exposing a portion of the broken key, facilitating extraction thereof.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a somewhat enlarged, partial, perspective view of a first embodiment of the cylinder lock according to the present invention;

FIG. 2. is a perspective view of the cylinder end plate of the embodiment of FIG. 1;

Figure 1:
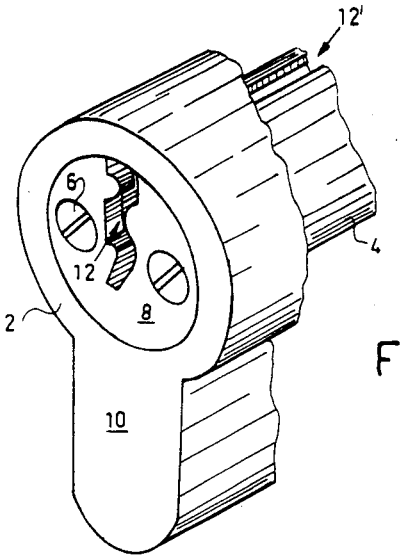
Figure 2:
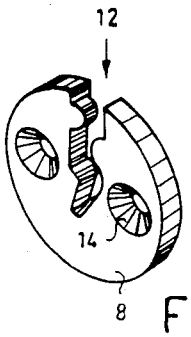
Figure 4:
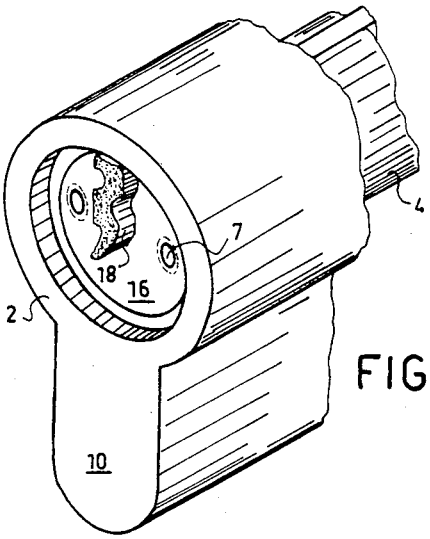
FIG. 4 is a partial, perspective view of the embodiment of FIG. 1, with the end plate removed and a portion of a broken key projecting from the cylinder.

Referring now to the drawings (in which, for reasons of clarity, no reference has been made to the per se known pin-tumbler system and its components such as pins, their bores, springs, etc.), there is seen in FIG. 1 a lock housing 2 which accommodates a cylinder 4. To the front end of the latter is removably attached by means of two preferably countersunk screws 6 an end plate 8, shown separately in FIG. 2. As can be seen in FIG. 1, the end plate 8 is completely countersunk in the housing 2 (see also FIG. 4), being substantially flush with the frontal surface 10 of the housing 2. Particularly clear from FIG. 2 is the key slot 12 of the end plate 8, which in the attached state of the latter is in register with an identical key slot 12' in the cylinder, the open, upper portion of which key slot can be seen in FIG. 1. Also seen in FIG. 2 are the countersinks 14 for the heads of the screws 6 of FIG. 1. In the embodiment described, the thickness of the end plate 8 is 1–2 mm. Also provided on the face of the end plate, but not shown for sake of clarity, is the as such known funnel-like guide recess at the upper half of the key slot 12, which facilitates introduction of the key into the key slot.

Figure 3:
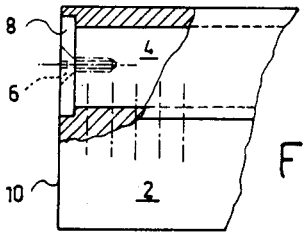
FIG. 3 is a partial view, in cross section of the embodiment of FIG. 1.

FIG. 3 illustrates the position of the cylinder/end plate assembly in the lock housing. As can be seen, the outside diameter of the end plate 8 is slightly larger than the outside diameter of the cylinder 4.

As already mentioned, a key for a cylinder lock will always break flush with the face of the lock, which, in the lock according to the invention, is the outside face of the end plate 8. To extract the broken key, all one has to do is to unscrew the two screws 6 with the aid of a screwdriver and remove the end plate 8 which comes off easily, leaving the lock in the state shown in FIG. 4. There is seen the end face 16 of the cylinder 4, including two threaded holes 7 for the screws 6. The broken key shaft 18 is now seen to protrude from the cylinder end face 16 by a distance equal to the thickness of the end plate 8, which is about 1–2 mm, enough to be gripped and extracted with the aid of a simple pair of pliers.

Figure 5:
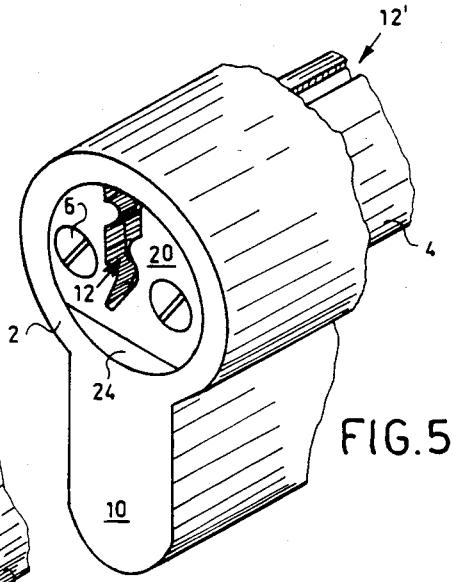
FIG. 5 is an equally enlarged, partial, perspective view of a second embodiment of the cylinder lock according to the present invention.
Figure 7:
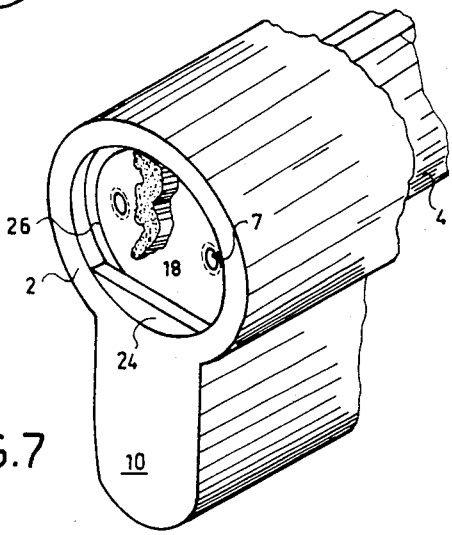
FIG. 7 is a partial, perspective view of the embodiment of FIG. 5, with the end plate removed and a portion of a broken key projecting from the cylinder.
Figure 6:
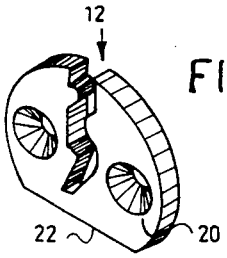
FIG. 6 is a perspective view of the cylinder end plate of the embodiment of FIG. 5.

FIGS. 5–7 represent a second, improved embodiment of the invention, greatly reducing the possibilities of tampering with the pin tumblers, as will be explained further below. The difference is most obvious in the end plate 20 shown in FIG. 6, which now has the shape of atruncated disk. The "chord" 22 of the segment cut away is perpendicular to the general axial plane of the key slot 12. In assembly, as seen in FIG. 5, the empty space left by the cut-away portion is filled by a real segment 24 which complements the truncated disk of the end plate 20, yet is an integral part of the cylinder 4, as clearly seen in FIG. 7, which is the analogue of FIG. 4. This segment 24, arranged in front of the axial row of pin tumblers (not shown, but represented in FIG. 3 by center lines), covers up the interface clearance 26 (FIG. 7) between cylinder 4 and housing 2 at this point and prevents any manipulation of the pins through this clearance.

Extraction of a broken key is effected in the same manner as with the previous embodiment.

While this specification used as an example of the present invention the most widely used type of cylinder lock, namely the twin cylinder door lock (of which in the drawings only one half, i.e., one cylinder, was shown, the other half being identical), the lock according to the invention can also be used for all other applications of cylinder locks, for instance in padlocks, for drawers, file cabinets and for access locks to critical or privileged control equipment or switch gear. Ignition locks are equally suitable for application of the present invention.

It will be evident to those skilled in the art that the invention is not limited to the details of the foregoing illustrative embodiments, and that the present invention may be embodied in other specific forms without departing from the essential attributes thereof, and it is therefore desired that the present embodiments be considered in all respects as illustrative and not restrictive, reference being made to the appended claims rather than to the foregoing description, and all changes which come with the meaning and range of equivalency of the claims are therefore intended to be embraced therein.

What is claimed is:

1. A cylinder lock comprising a housing and, rotatably accommodated in said housing, a cylinder having an axially extending key slot for reception of a mating key to permit rotation of said cylinder within said housing by action of said mating key to unlock saod lock, an end plate having a similar key slot cut therethrough, and means for removably attaching said end plate to one end of said cylinder with the end plate completed countersunk in said lock housing and with the key slot of said end plate in register with the key slot of said cylinder to permit insertion, through said end plate, into said cylinder, of the mating key, whereby in case of a broken key, said end plate can be removed form said cylinder, thereby exposing a portion of the broken key, facilitating extraction thereof.

2. The lock as claimed in claim 1, wherein said end plate is substantially disk-shaped.

3. The lock as claimed in claim 1, wherein said means for attaching said end plate to said cylinder is at least one screw countersunk in said end plate and screwed into a threaded hole in said cylinder while permitting ready removal of said at least one screw and said end plate.

4. The lock as claimed in claim 1, wherein said end plate is in the form of a truncated disk, with the chord of the segment removed being substantially perpendicular to the general axial plane of said key slot.

5. The lock as claimed in claim 4, wherein said end of said cylinder is provided with a disk-segment-like projection substantially identical in shape and size to that of said removed segment, and, in assembly, complementing said truncated disk.

* * * * *